US006729150B2

(12) United States Patent
Shin et al.

(10) Patent No.: US 6,729,150 B2
(45) Date of Patent: May 4, 2004

(54) METHOD OF CONTROLLING MULTI-COMPARTMENT TYPE KIMCHI REFRIGERATOR

(75) Inventors: Kyu-Ho Shin, Kwangju (KR); Sung-Ho Cho, Kwangju (KR); Woo-Yeol Yoo, Jullanam-Do (KR)

(73) Assignee: Samsung Electronics Co., LTD, Suwon-si (KR)

( * ) Notice: Subject to any disclaimer, the term of this patent is extended or adjusted under 35 U.S.C. 154(b) by 0 days.

(21) Appl. No.: 10/317,070

(22) Filed: Dec. 12, 2002

(65) Prior Publication Data

US 2004/0003613 A1 Jan. 8, 2004

(30) Foreign Application Priority Data

Jul. 4, 2002 (KR) ..... 2002-38748

(51) Int. Cl.[7] ..... F25B 5/00
(52) U.S. Cl. ..... 62/199; 62/223
(58) Field of Search ..... 62/199, 200, 223, 62/504

(56) References Cited

U.S. PATENT DOCUMENTS 4,655,050 A * 4/1987 Aschberger et al. ..... 62/200
5,465,591 A * 11/1995 Cur et al. ..... 62/439
5,477,915 A * 12/1995 Park ..... 165/30
6,063,420 A * 5/2000 Chun et al. ..... 426/231
6,189,323 B1 * 2/2001 Nakamura et al. ..... 62/157
6,526,769 B2 * 3/2003 Kim ..... 62/199

FOREIGN PATENT DOCUMENTS

KR 2001-16944 3/2001

* cited by examiner

*Primary Examiner*—Marc Norman
(74) *Attorney, Agent, or Firm*—Staas & Halsey LLP

(57) ABSTRACT

A method of controlling a multi-compartment type kimchi refrigerator having a plurality of evaporators which are mounted in respective storage compartments to refrigerate the storage compartments, a compressor which supplies the evaporators with refrigerant, and valves which are mounted in inlet sides of the evaporators, respectively, to be selectively opened and closed on the basis of temperatures of the storage compartments. The method includes selectively opening or closing the valves in priority order of operations of the valves in response to a signal to supply the refrigerant to two or more of the evaporators.

20 Claims, 6 Drawing Sheets

METHOD OF CONTROLLING MULTI-COMPARTMENT TYPE KIMCHI REFRIGERATOR

CROSS-REFERENCE TO RELATED APPLICATIONS

This application claims the benefit of Korean Patent Application No. 2002-38748 filed on Jul. 4, 2002, in the Korean Intellectual Property Office, the disclosure of which is incorporated herein by reference.

BACKGROUND OF THE INVENTION

1. Field of the Invention

The present invention relates to a method of controlling a multi-compartment type kimchi refrigerator, which has and can efficiently refrigerate a plurality of storage compartments.

2. Description of the Related Art

Generally, storage compartments of a conventional multi-compartment type kimchi refrigerator are provided with evaporators to supply cold air, and refrigerant supplied from a single compressor is provided to the evaporators in the storage compartments through capillary tubes connected to the evaporators.

The conventional multi-compartment type kimchi refrigerator senses the temperatures of the storage compartments through temperature sensors provided to the corresponding storage compartments, and temperature information obtained from the storage compartments is transmitted to a control unit, which controls an operation of the refrigerator, to control the compressor. Additionally, valves are mounted in refrigerant passages connected to the evaporators, and are selectively opened and closed under the control of the control unit to control the supply of the refrigerant supplied from the compressor to the evaporators.

Accordingly, in the conventional multi-compartment type kimchi refrigerator, where a temperature of one of the storage compartments increases to a higher temperature than a preset reference temperature, the respective temperature sensor senses the increase of temperature of the storage compartment, and the control unit opens the corresponding refrigerant passage connected to the corresponding evaporator of the storage compartment by controlling the respective valve and operating the compressor. Accordingly, the storage compartment with the increased temperature is refrigerated.

However, in the conventional multi-compartment type kimchi refrigerator, where temperatures of two or more of the storage compartments increase to higher temperatures than the preset reference temperature, the valves corresponding to the two or more of the storage compartments are opened. As such, the entire amount and pressure of the refrigerant produced by the compressor are divided into a number of storage compartments to be refrigerated. In this case, only a small amount of the refrigerant having a low pressure is supplied to each of the corresponding evaporators. Accordingly, in such instances, the conventional kimchi refrigerator is problematic in that refrigeration efficiencies in the storage compartments decrease and the entire refrigeration cycle of the refrigerator becomes unstable.

SUMMARY OF THE INVENTION

Accordingly, an aspect of the present invention is to provide a method of controlling a multi-compartment type kimchi refrigerator, where in response to a signal to supply refrigerant to a plurality of evaporators, provides the entire amount of the refrigerant with the entire pressure, which is produced by a compressor, to a single compartment for a corresponding preset opening time. The method includes sequentially opening valves of the refrigerator according to the preset opening times of the valves, thereby improving a refrigerating efficiency of the multi-compartment type kimchi refrigerator.

Another aspect of the present invention is to provide a method of controlling a multi-compartment type kimchi refrigerator, which is capable of controlling and providing a constant amount and pressure of refrigerant to storage compartments of the refrigerator.

Additional aspects and advantages of the invention will be set forth in part in the description which follows and, in part, will be obvious from the description, or may be learned by practice of the invention.

To achieve the above and other aspects of the present invention, there is provided a method of controlling a multi-compartment type kimchi refrigerator having storage compartments, evaporators which are mounted in the corresponding storage compartments to refrigerate the storage compartments, a compressor which supplies the evaporators with refrigerant, and valves which are mounted in respective inlet sides of the evaporators and are selectively opened and closed according to temperatures of the storage compartments, the method comprising selectively opening or closing the valves in priority order of operations of the valves in response to a signal to supply the refrigerant to two or more of the evaporators.

To achieve the above and other aspects of the present invention, there is provided another method of controlling a multi-compartment type kimchi refrigerator having storage compartments, evaporators which are mounted in the corresponding storage compartments to refrigerate the storage compartments, a compressor which supplies the evaporators with refrigerant, and valves which are mounted in respective inlet sides of the evaporators and are selectively opened and closed according to temperatures of the storage compartments, the method comprising determining whether supplying the refrigerant to two or more of the evaporators is necessary based upon the temperatures of the storage compartments, setting priority order of operations of the valves in response to a determination to supply the refrigerant to the two or more of the evaporators, calculating respective opening times of the valves according to the set priority order of operations of the valves, and opening the valves based upon the calculated respective opening times.

BRIEF DESCRIPTION OF THE DRAWINGS

These and other objects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
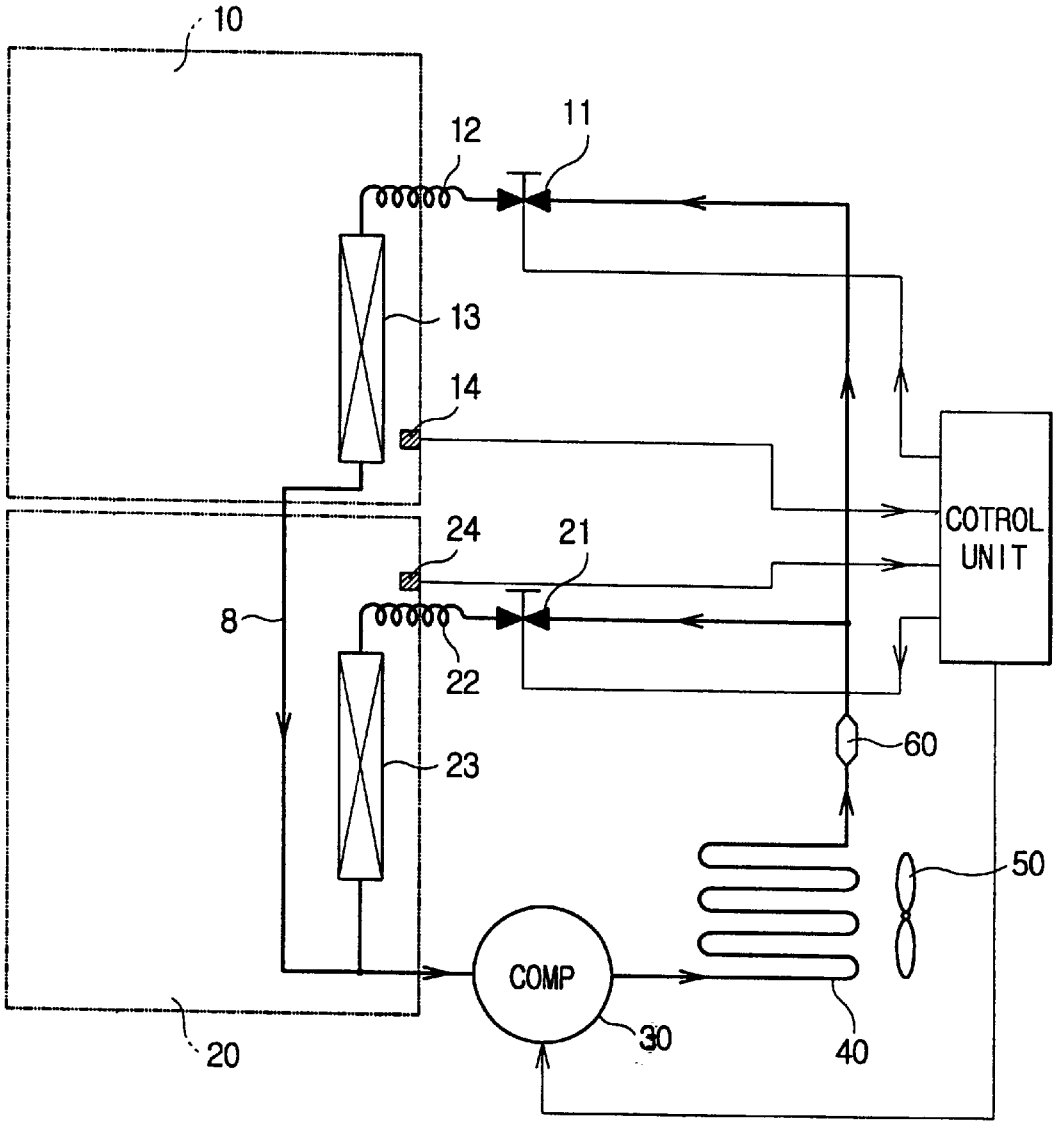
FIG. 1 is a diagram illustrating a refrigeration cycle of a multi-compartment type kimchi refrigerator according to an embodiment of the present invention.

Reference will now be made in detail to the embodiments of the present invention, examples of which are illustrated in the accompanying drawings, wherein like reference numerals refer to the like elements throughout. The embodiments are described below in order to explain the present invention by referring to the figures.

FIG. 1 shows a diagram illustrating a refrigeration cycle of a multi-compartment type kimchi refrigerator according to an embodiment of the present invention.

Referring to FIG. 1, the multi-compartment type kimchi refrigerator of the present invention includes a storage space having first and second storage compartments 10 and 20. First and second evaporators 13 and 23 are mounted in the first and second storage compartments 10 and 20, and perform a heat exchange operation with the interiors of the storage compartments, respectively.

The refrigerator further includes a compressor 30 which compresses refrigerant sucked from outlet sides of the first and second evaporators 13 and 23, a condenser 40 which condenses the refrigerant compressed by the compressor 40, a fan 50 which aids rapid heat exchange in the condenser 40, and a dryer 60 which is positioned downstream of the condenser 51.

First and second capillary tubes 12 and 22 are connected in parallel to an outlet side of the dryer 60 at their inlet sides, and connected to corresponding inlet sides of the evaporators 13 and 23 at their respective outlet sides.

First and second valves 11 and 21 are positioned in corresponding refrigerant passages between the capillary tubes 12 and 22 and the dryer 60, so as to regulate a flow of the refrigerant to the evaporators 13 and 23.

Additionally, first and second temperature sensors 14 and 24 are provided in the corresponding storage compartments 10 and 20 to sense the temperatures of the interiors of the storage compartments 10 and 20, respectively. The temperature sensors 14 and 24 are electrically connected to a control unit 100 that will be described later.

Figure 2:
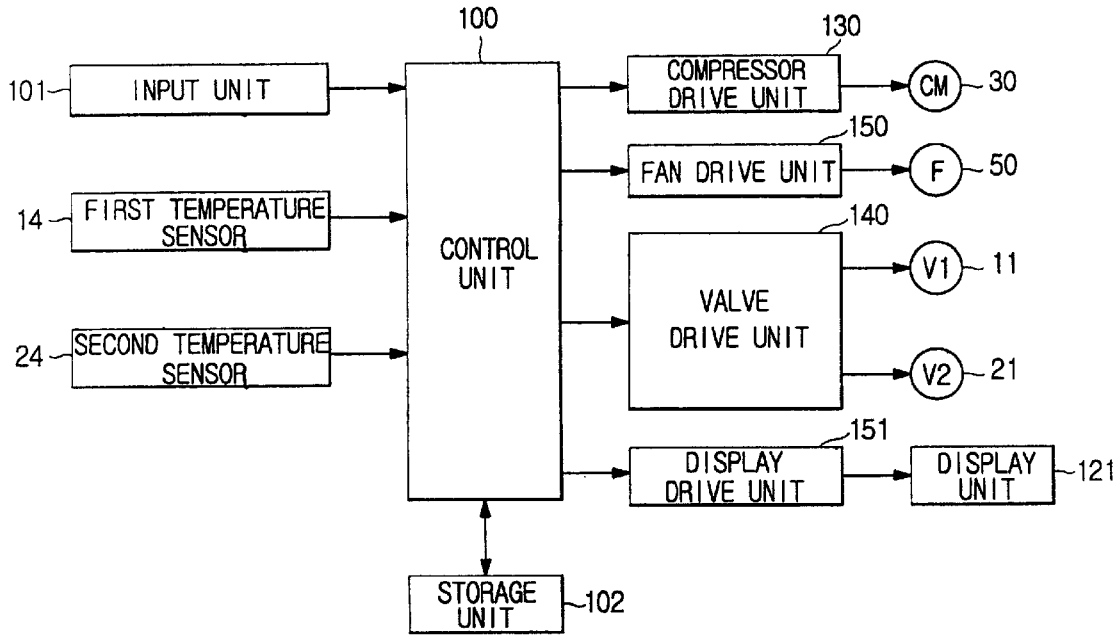
FIG. 2 is a block diagram illustrating a control-related configuration of a multi-compartment type kimchi refrigerator of the present invention.

FIG. 2 shows a block diagram illustrating a control-related configuration of a multi-compartment type kimchi refrigerator of the present invention.

Referring to FIG. 2, the refrigerator comprises a control unit 100 which controls the overall operation of the refrigerator, an input unit 101 which receives commands from, for example, a user and transmits signals corresponding to the commands to the control unit 100, a storage unit 102 which stores data, and temperature sensors 14 and 24 which detect the temperatures of the storage compartments 10 and 20, respectively, and are electrically connected to the control unit 100.

The refrigerator further comprises, a compressor drive unit 130, a fan drive unit 150, and a valve drive unit 140 which are electrically connected to the control unit 100. The compressor drive unit 130 and the fan drive unit 150 drive a compressor 30 and a fan 50 of the refrigerator, respectively. The valve drive unit 140 controls operations of valves 11 and 21 that selectively open and close refrigerant passages connected to evaporators 13 and 23 of the refrigerator, respectively. Additionally, a display unit 121 that displays an operating state of the refrigerator, and a display drive unit 151 which operates the display unit 121 are electrically connected to the control unit 100.

Figure 3A:
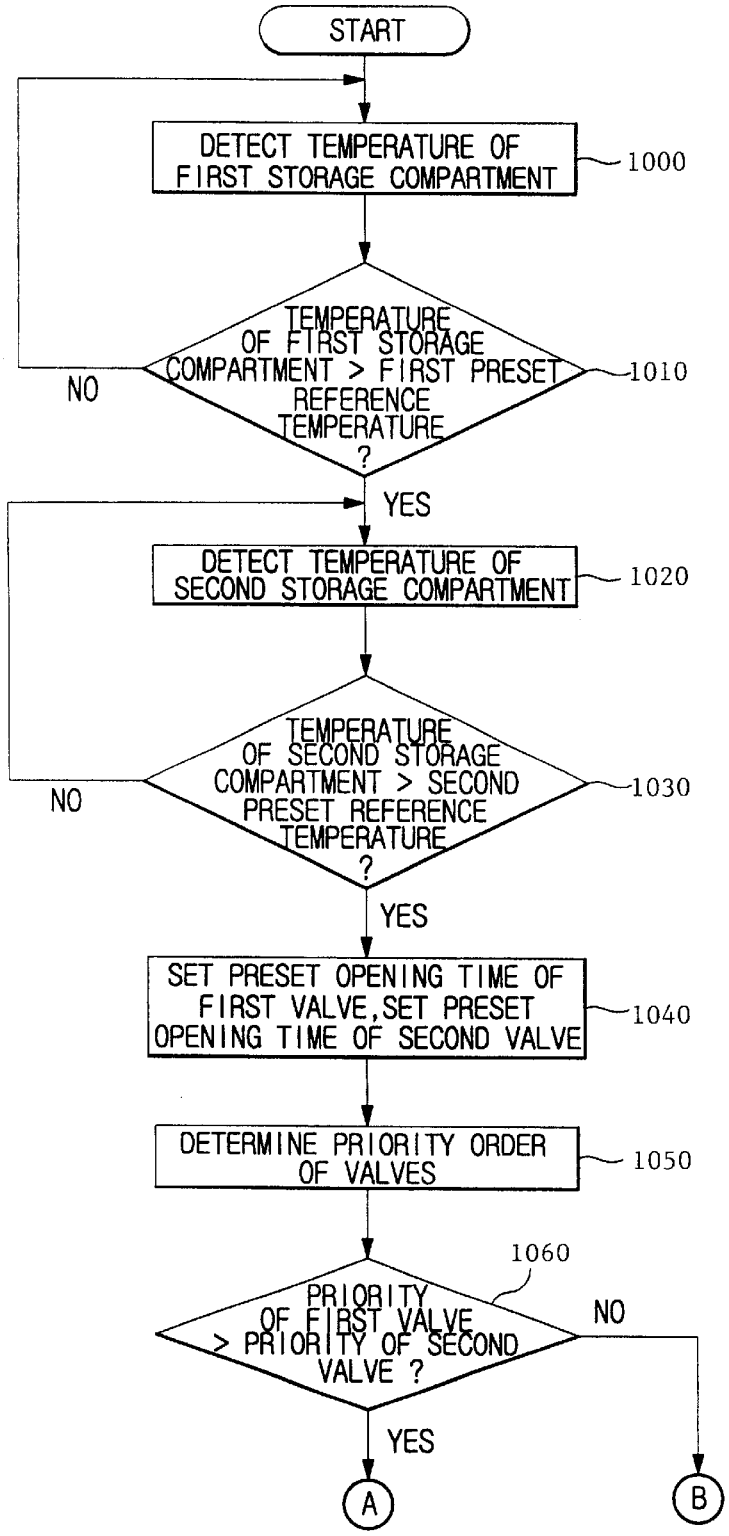
FIGS. 3A to 3C are flowcharts illustrating a method of controlling a multi-compartment type kimchi refrigerator of the present invention.
Figure 3B:
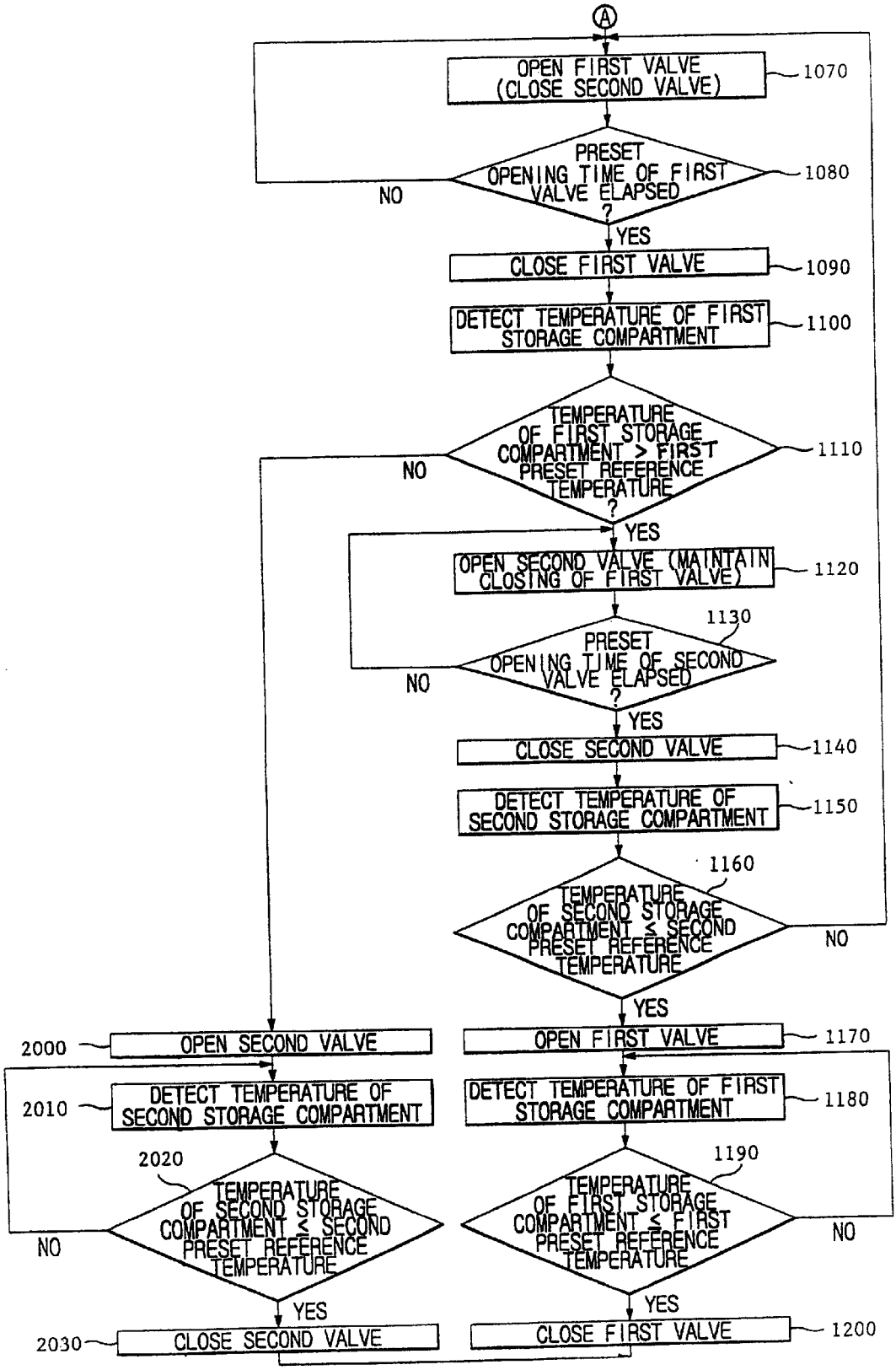
Figure 3C:
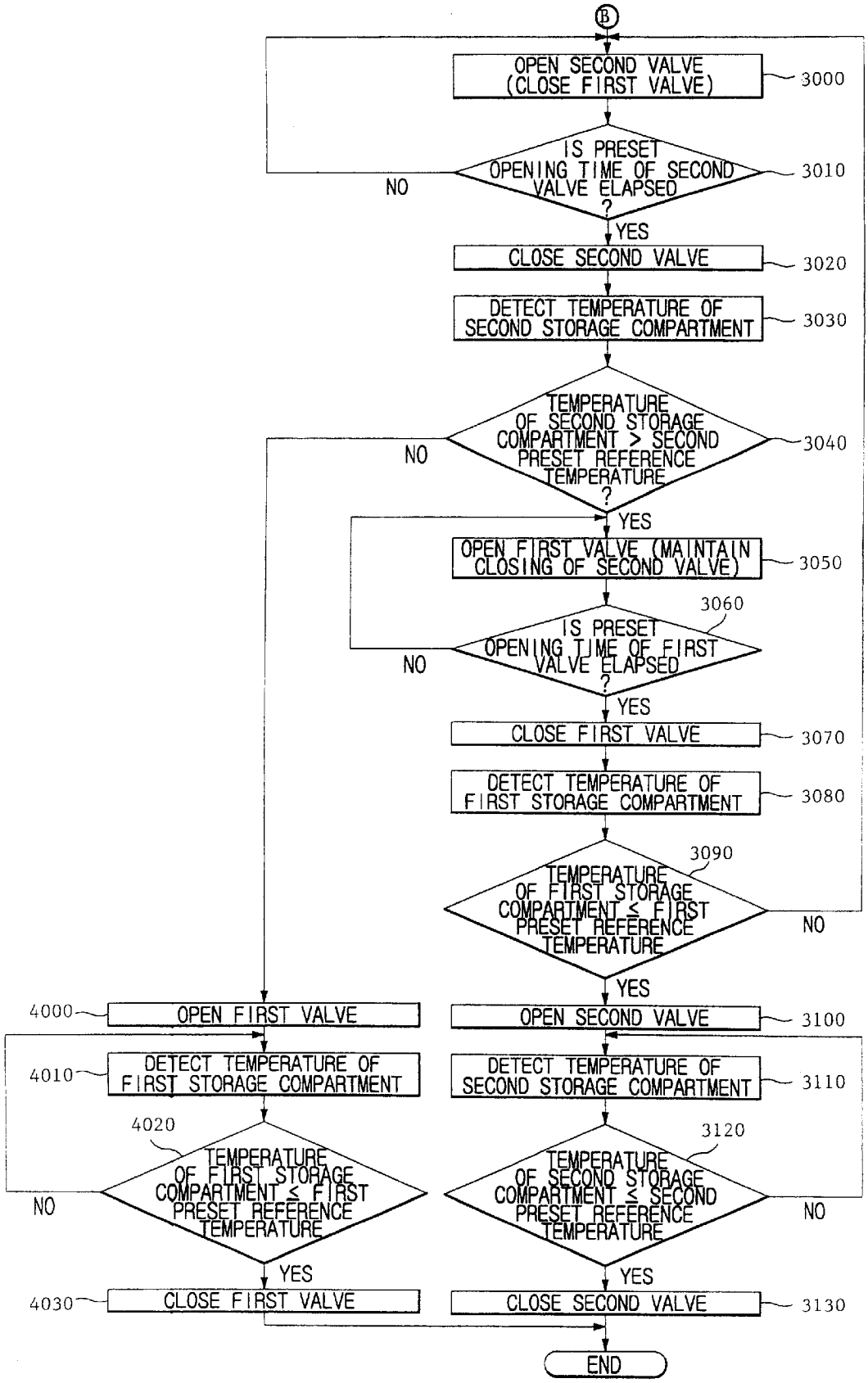

FIGS. 3A to 3C show flowcharts illustrating a method of controlling a multi-compartment type kimchi refrigerator of the present invention.

Referring to FIGS. 3A to 3C, with reference to FIGS. 1 and 2, the first temperature sensor 14 detects a temperature of the first storage compartment 10 under the control of the control unit 100 in operation 1000.

Where the temperature of the first storage compartment 10 is detected, the control unit 100 determines whether the detected temperature of the first storage compartment 10 is higher than a first preset reference temperature by comparing the temperature of the first storage compartment 10 with the first preset reference temperature set for the first storage compartment 10, in operation 1010.

Where the detected temperature of the first storage compartment 10 is higher than the first preset reference temperature in the operation 1010, the second temperature sensor 24 detects a temperature of the second storage compartment 20 under the control of the control unit 100 in operation 1020.

Where the temperature of the second storage compartment 20 is detected, the control unit 100 determines whether the detected temperature of the second storage compartment 20 is higher than a second preset reference temperature by comparing the temperature of the second storage compartment 20 with the second preset reference temperature set for the second storage compartment 20, in operation 1030.

Where the detected temperature of the second storage compartment 20 is higher than the second preset reference temperature in the operation 1030, the control unit sets respective preset opening times of the first and second valves 11 and 21 in operation 1040. In this case, the control unit 100 controls the valves 11 and 21 to be opened in order of the respective preset opening times by setting the respective preset opening times of the valves 11 and 21 differently from each other, so as not to simultaneously open the valves 11 and 21, as shown in FIG. 4.

Figure 4:
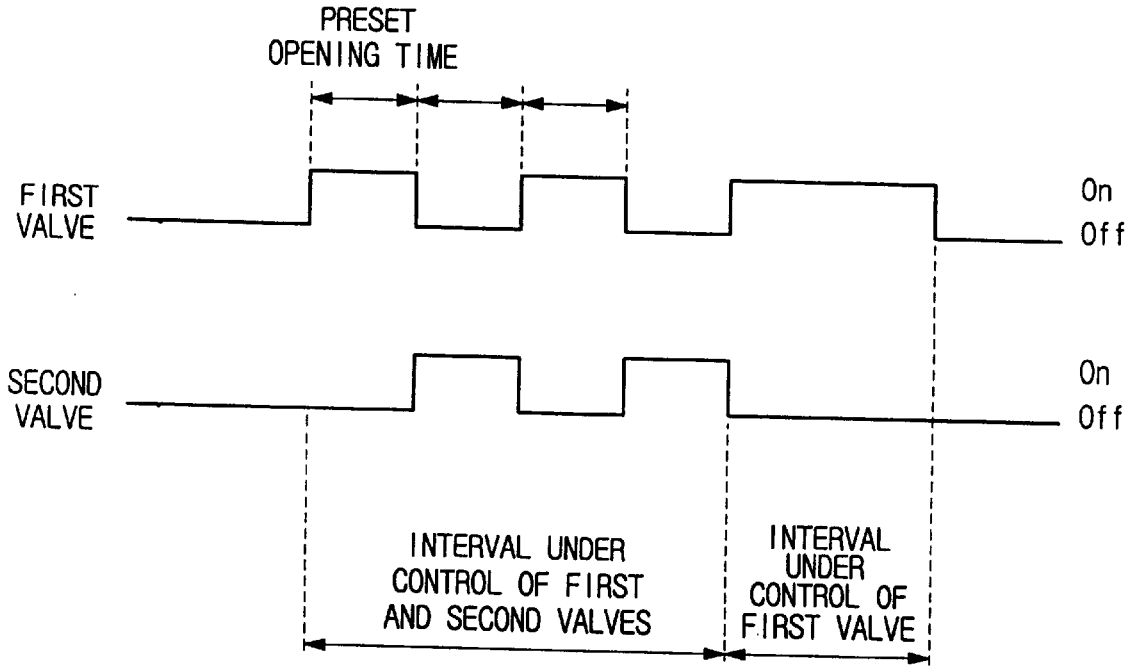
FIG. 4 is a timing chart for valves corresponding to FIGS. 3A to 3C.

Thereafter, where the respective opening times are set, the control unit 100 determines priority order of operations of the first and second valves 11 and 21 as shown in FIG. 4 in operation 1050. In this case, the control unit 100 may grant a lower priority to a valve in operation in determining the priority order of operations. Additionally, the control unit 100 may determine the priority order of operations in proportion to differences between the detected temperatures of the storage compartment 10 and 20 and the first and second preset reference temperatures.

Where the priority order is determined, the control unit 100 determines whether the priority of the first valve 11 is higher than the priority of the second valve 21 by comparing the priority of the first valve 11 with the priority of the second valve 21 in operation 1060.

Where the priority of the first valve 11 is higher than the priority of the second valve 21 in the operation 1060, the control unit 100 controls the valve drive unit 140 to open the first valve 11 so as to supply the refrigerant generated by the compressor 30 to the first evaporator 13 of the first storage compartment 10 through the first capillary tube 12 with the valve drive unit 140 closing the second valve 21, in operation 1070.

Thereafter, in operation 1080, the control unit 100 counts an opening time of the first valve 11 and determines whether the counted opening time is longer than a preset opening time of the first valve 11 set in the operation 1040.

Where the counted opening time is longer than the preset opening time of the first valve 11 in the operation 1080, the control unit 100 controls the valve drive unit 140 to close the first valve 11 so as to cut off the refrigerant supplied to the first evaporator 13 of the first storage compartment 10 in operation 1090.

After the first valve 11 is closed, the first temperature sensor 14 detects a temperature of the first storage compartment 10 under the control of the control unit 100 in operation 1100.

Thereafter, the control unit 100 determines whether the temperature of the first storage compartment 10 is higher than the first preset reference temperature by comparing the temperature of the first storage compartment 10 detected by the first temperature sensor 14 with the first preset reference temperature set for the first storage compartment 10, in operation 1110.

Where the temperature of the first storage compartment 10 is higher than the first preset reference temperature in the operation 1110, the control unit 100 controls the valve drive unit 140 to open the second valve 21 so as to supply the refrigerant compressed by the compressor 30 to the second evaporator 23 of the second storage compartment 20 through the second capillary tube 22 with the valve drive unit 140 maintaining the first valve 21 closed, in operation 1120.

Thereafter, in operation 1130, the control unit 100 counts an opening time of the second valve 21 and determines whether the counted opening time is longer than the preset opening time of the second valve 21 set in the operation 1040.

Where the counted opening time is longer than the preset opening time of the second valve 21 in the operation 1130, the control unit 100 controls the valve drive unit 140 to close the second valve 21 so as to cut off the refrigerant supplied to the second evaporator 23 of the second storage compartment 20 in operation 1140.

After the second valve 21 is closed, the second temperature sensor 24 detects a temperature of the second storage compartment 20 under the control of the control unit 100 in operation 1150.

Thereafter, the control unit 100 determines whether the temperature of the second storage compartment 20 is equal to or lower than the second preset reference temperature by comparing the temperature of the second storage compartment 20 detected by the second temperature sensor 24 with the second preset reference temperature set for the second storage compartment 20, in operation 1160.

Where the temperature of the second storage compartment 20 is equal to or lower than the second preset reference temperature in the operation 1160, the control unit 100 controls the valve drive unit 140 to open the first valve 11 so as to supply the refrigerant generated by the compressor 30 to the first evaporator 13 of the first storage compartment 10 through the first capillary tube 12, in operation 1170.

Thereafter, the first temperature sensor 14 detects a temperature of the first storage compartment 10 under the control of the control unit 100 in operation 1180.

Thereafter, where the temperature of the first storage compartment 10 is detected, the control unit 100 determines whether the temperature of the first storage compartment 10 is equal to or lower than the first preset reference temperature by comparing the temperature of the first storage compartment 10 with the first preset reference temperature set for the first storage compartment 10, in operation 1190.

Where the temperature of the first storage compartment 10 is equal to or lower than the first preset reference temperature in the operation 1190, the control unit 100 controls the valve drive unit 140 to close the first valve 11 so as to cut off the refrigerant supplied to the first evaporator 13 of the first storage compartment 10 in operation 1200.

Meanwhile, where the temperature of the second storage compartment 20 is higher than the second preset reference temperature in the operation 1160, the control unit 100 returns to the operation 1070 and controls the first valve 11.

Hereinafter, a case where the temperature of the first storage compartment 10 is equal to or lower than first preset reference temperature in the operation 1110 is described.

Where the temperature of the first storage compartment 10 is equal to or lower than the first preset reference temperature in the operation 1110, the control unit 100 controls the valve drive unit 140 to open the second valve 21 so as to supply the refrigerant generated by the compressor 30 to the second evaporator 23 of the second storage compartment 20 through the second capillary tube 22, in operation 2000.

Thereafter, the second temperature sensor 24 detects a temperature of the second storage compartment 20 under the control of the control unit 100 in operation 2010.

Thereafter, where the temperature of the second storage compartment 20 is detected, the control unit 100 determines whether the temperature of the second storage compartment 20 is equal to or lower than the second preset reference temperature by comparing the temperature of the second storage compartment 20 with the second preset reference temperature set for the second storage compartment 20, in operation 2020.

Where the temperature of the second storage compartment 20 is equal to or lower than the second preset reference temperature in the operation 2020, the control unit 100 controls the valve drive unit 140 to close the second valve 21 so as to cut off the refrigerant supplied to the second evaporator 23 of the second storage compartment 20 in operation 2030.

Hereinafter, a case where the priority of the second valve 21 is higher than the priority of the first valve 11 in the operation 1060 is described.

Where the priority of the second valve 21 is higher than the priority of the first valve 11 in the operation 1060, the control unit 100 controls the valve drive unit 140 to open the second valve 21 first as shown in FIG. 3C instead of controlling the valve drive unit 140 to open the first valve 21 first, as shown in FIG. 3B, in the case where the priority of the first valve 11 is higher than the priority of the second valve 21. To avoid repetition, detailed explanations of operations of FIG. 3C are not presented, in view of FIG. 3B and the descriptions presented thereof.

As described above, where it is necessary to supply refrigerant to a plurality of evaporators, the multi-compartment type kimchi refrigerator control method of the present invention provides the entire amount and pressure of the refrigerant to a single compartment of the refrigerator, for a corresponding preset opening time, by sequentially opening valves of the refrigerator on the basis of preset opening times of the valves. Accordingly, a refrigerating efficiency of the multi-compartment type kimchi refrigerator is improved.

Additionally, in the multi-compartment type kimchi refrigerator control method of the present invention, the amount and pressure of the refrigerant supplied to the storage compartments are constant. Therefore, stability of a refrigeration cycle of the multi-compartment type kimchi refrigerator is improved.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A method of controlling a multi-compartment type kimchi refrigerator having storage compartments, evaporators which are mounted in the corresponding storage compartments to refrigerate the storage compartments, a compressor which supplies the evaporators with refrigerant, and valves which are mounted in respective inlet sides of the evaporators and are selectively opened and closed according to temperatures of the storage compartments, the method comprising selectively opening or closing the valves in priority order of operations of the valves in response to a signal to supply the refrigerant to two or more of the evaporators.

2. The method according to claim 1, wherein the selectively opening or closing of the valves comprises opening a single one of the valves for a corresponding opening time according to the priority order of operations of the valves.

3. The method according to claim 1, wherein selectively opening or closing of the valves comprises:

opening a single one of the valves having a highest priority of the priority order of operations for a corresponding opening time; and providing the single one of the valves the entire amount and pressure of the refrigerant to one of the evaporators corresponding to the single one of the valves.

4. The method according to claim 1, further comprising providing a constant amount and pressure of the refrigerant to the evaporators.

5. A method of controlling a multi-compartment type kimchi refrigerator having storage compartments, evaporators which are mounted in the corresponding storage compartments to refrigerate the storage compartments, a compressor which supplies the evaporators with refrigerant, and valves which are mounted in respective inlet sides of the evaporators and are selectively opened and closed according to temperatures of the storage compartments, the method comprising:

determining whether supplying the refrigerant to two or more of the evaporators is necessary based upon the temperatures of the storage compartments;

setting priority order of operations of the valves in response to a determination to supply the refrigerant to the two or more of the evaporators;

calculating respective opening times of the valves based upon the set priority order of operations of the valves; and opening the valves based upon the calculated respective opening times.

6. The method according to claim 5, wherein the setting of the priority order of operations comprises granting one or more of the valves in operation a lower priority than one or more of the valves not in operation.

7. The method according to claim 5, wherein the setting of the priority order of operations comprises setting the priority order of operations of the valves according to respective differences between the detected temperatures of the storage compartments and preset reference temperatures of the storage compartments.

8. The method according to claim 7, wherein the priority order of operations of the valves are set in proportion to the respective differences between the detected temperatures of the storage compartments and preset reference temperatures of the storage compartments.

9. The method according to claim 5, wherein the calculating of the respective opening times of the valves includes setting the respective opening times of the valves differently from each other, so as not to open the valves simultaneously.

10. The method according to claim 5, wherein the opening of the valves comprises:

opening one of the valves having a highest priority of the priority order of operations while closing the other valve;

closing the one of the valves in response to elapse of a corresponding one of the respective opening times of the valves and detecting a current temperature of one of the storage compartments corresponding to the valve being closed;

in response to the current temperature of the one of the storage compartments being greater than a first preset temperature, opening the other valve until a current temperature of the other storage compartment corresponding to the other valve is equal to or less than a second preset temperature; and in response to the current temperature of the one of the storage compartments being not greater than the first preset temperature:

opening the other valve while maintaining the one of the valves closed, closing the other valve in response to elapse of the other respective opening time and detecting the current temperature of the other storage compartment corresponding to the other valve being closed, in response to the current temperature of the other storage compartment being equal to or less than the second preset temperature, opening the one of the valves until the current temperature of the one of the storage compartments is equal to or less than the first preset temperature, and in response to the current temperature of the other storage compartment being greater than the second preset temperature, returning to operations of the opening of the valves.

11. A refrigerator comprising:

storage compartments;

evaporators which are mounted in the corresponding storage compartments and perform a heat exchange operation of the refrigerator;

a compressor which supplies the evaporators with refrigerant;

valves which are mounted in respective inlet sides of the evaporators to regulate a flow of the refrigerant to the evaporators; and a control unit which selectively opens and closes the valves according to priority order of operations of the valves in response to a signal to supply the refrigerant to two or more of the evaporators.

12. The refrigerator according to claim 11, wherein the control unit opens a single one of the valves for a corresponding opening time according to the priority order of operations of the valves.

13. The refrigerator according to claim 11, wherein the control unit opens a single one of the valves having a highest priority of the priority order of operations for a corresponding opening time, and provides the single one of the valves the entire amount and pressure of the refrigerant to one of the evaporators corresponding to the single one of the valves.

14. The refrigerator according to claim 11, wherein the control unit sets the priority order of operations by granting one or more of the valves in operation a lower priority than one or more of the valves not in operation.

15. The refrigerator according to claim 11, wherein the control unit sets the priority order of operations according to respective differences between temperatures of the storage compartments detected and preset reference temperatures of the storage compartments.

16. The refrigerator according to claim 11, wherein the control unit:

determines whether it is necessary to supply the refrigerant to two or more of the evaporators according to temperatures of the storage compartment, sets the priority order of operations of the valves in response to a determination to supply the refrigerant to the two or more of the evaporators, calculates respective opening times of the valves according to the set priority oder of operations of the valves, and selectively opens and closes the valves according to the calculated respective opening times.

17. The refrigerator according to claim 16, wherein the control unit sets the respective opening times of the valves differently from each other, so as not to open the valves simultaneously.

18. The refrigerator according to claim 16, wherein the control unit sets the priority order of operations of the valves according to respective differences between the temperatures of the storage compartments detected and preset reference temperatures of the storage compartments.

19. The refrigerator according to claim 11, further comprising:

temperature sensors which are provided in the corresponding storage compartments;

a condenser which condenses the refrigerant;

a fan which promotes heat exchange in the condenser;

a storage unit which stores data of the refrigerator;

a display unit which displays an operating state of the refrigerator;

an input unit which receives control information of the refrigerator;

a compressor drive units which drives the compressor;

a fan drive unit which drives the fan;

a valve drive unit which drives the valves; and a display drive unit which drives the display unit.

20. The refrigerator according to claim 11, wherein the refrigerator is a multi-compartment type kimchi refrigerator.

* * * * *